US011454392B2

(12) United States Patent
Lhoest et al.

(10) Patent No.: US 11,454,392 B2
(45) Date of Patent: Sep. 27, 2022

(54) DEVICE FOR INDIRECT HEATING BY RADIATION IN THE FORM OF A RADIANT HOUSING

(71) Applicant: DREVER INTERNATIONAL S.A., Liège (BE)

(72) Inventors: Alexandre Lhoest, Eupen (BE); Olivier Pensis, Montegnée (BE)

(73) Assignee: DREVER INTERNATIONAL S.A., Liège (BE)

( * ) Notice: Subject to any disclaimer, the term of this patent is extended or adjusted under 35 U.S.C. 154(b) by 0 days.

(21) Appl. No.: 16/521,341

(22) Filed: Jul. 24, 2019

(65) Prior Publication Data

US 2019/0346132 A1 Nov. 14, 2019

Related U.S. Application Data

(63) Continuation of application No. 15/165,614, filed on May 26, 2016, now Pat. No. 10,502,412.

(30) Foreign Application Priority Data

May 28, 2015 (BE) ..... 2015/5331

(51) Int. Cl.

| | |
|---|---|
| ***F23C 3/00*** | (2006.01) |
| ***F27D 99/00*** | (2010.01) |
| ***F27B 9/06*** | (2006.01) |
| ***F23M 9/06*** | (2006.01) |
| ***F27B 9/36*** | (2006.01) |
| ***F23M 9/10*** | (2006.01) |

(52) U.S. Cl.

CPC ..... *F23C 3/002* (2013.01); *F23M 9/06* (2013.01); *F23M 9/10* (2013.01); *F27B 9/068* (2013.01); *F27B 9/36* (2013.01); *F27D 99/0035* (2013.01); *F27B 2009/3638* (2013.01)

(58) Field of Classification Search

CPC ..... F23C 3/002; F23D 14/12
USPC ..... 126/91 A
See application file for complete search history.

(56) References Cited

U.S. PATENT DOCUMENTS 2,946,510 A * 7/1960 Galvin ..... F24D 5/08 237/70
3,174,474 A * 3/1965 Jones ..... C21D 1/74 126/91 A
6,450,162 B1 9/2002 Wang et al.
(Continued)

FOREIGN PATENT DOCUMENTS

DE 3034193 A1 * 4/1982 ..... F28F 1/105
EP 0801265 A2 10/1997
EP 1203921 A1 5/2002
(Continued)

OTHER PUBLICATIONS

Translation of DE-3034193-A1.*
Translation of WO-2010029477-A2.*

*Primary Examiner* — Vivek K Shirsat
(74) *Attorney, Agent, or Firm* — Christensen O'Connor Johnson Kindness PLLC

(57) ABSTRACT

The present disclosure relates to a device for indirect heating by radiation in the form of a radiant housing having two front walls and two side walls and comprising at least one heat source, the radiant housing having front walls joining one another such that the housing has a lenticular shape in cross-section.

14 Claims, 5 Drawing Sheets

(56) References Cited

U.S. PATENT DOCUMENTS

| | | | | |
|---|---|---|---|---|
| 9,618,200 | B2 * | 4/2017 | Pitocco | F23C 3/002 |
| 2014/0008048 | A1 | 1/2014 | Bisson | |

FOREIGN PATENT DOCUMENTS

| | | | | |
|---|---|---|---|---|
| FR | 861541 | A | 2/1941 | |
| FR | 1315564 | A | 1/1963 | |
| WO | 2010/029477 | A2 | 3/2010 | |
| WO | WO-2010029477 | A2 * | 3/2010 | F23L 15/04 |

* cited by examiner

DEVICE FOR INDIRECT HEATING BY RADIATION IN THE FORM OF A RADIANT HOUSING

CROSS-REFERENCES TO RELATED APPLICATIONS

This application is a continuation of U.S. patent application Ser. No. 15/165,614, filed on May 26, 2016, which claims priority from Belgian Patent Application No. 2015/5331, filed on May 28, 2015, all the disclosures of which are incorporated by reference herein.

FIELD OF THE DISCLOSURE

Embodiments of the present disclosure relate to a device for indirect heating by radiation in the form of a radiant housing having, for example, two front walls and two side walls and comprising at least one heat source.

BACKGROUND

A heating device, based on the use of heat propagating by radiation (reference is then made to radiant heat) starting from a radiant element (notably manufactured from a metal alloy or ceramic), is in particular used in heat treatment furnaces within which products, typically metal products (such as bars, tubes, strips) are treated, but also, for example, products made from other materials, such as ceramics.

"Indirect heating" means that the heating is not done directly between the heat source (flame in the case of combustion) and the product to be treated.

Document FR 1,315,564 discloses one particular type of heating device having an elliptical shape, i.e., a shape made up of an infinity of arcs of circle and that can be obtained, by definition, as an envelope of the family of circles whereof the diameters are the parallel support chords of a given circle. An ellipse is in fact a closed plane curve generated by a point so moving that its distance from a fixed point divided by its distance from a fixed line is a positive constant less than 1.

Generally, the heat treatment furnaces comprise an entire series of radiant elements placed above one another and/or next to one another in vertical and/or horizontal rows. Generally, the products to be treated travel vertically and/or horizontally opposite these elements and/or between these elements, from which the radiant heat is emitted. To that end, each radiant element comprises at least one heat source, which may for example assume the form of a burner provided with at least one combustible product injector, at least one combustive inlet and at least one combustion gas outlet such that, supplied with a combustible product and a combustive, the burner develops a flame within the radiant element from which the heat then radiates toward the products to be treated.

Primarily, the radiant elements currently used and known from the state of the art consist of radiant tubes, different shapes of which are proposed. For example, a first type of radiant tube is the "W" tube, which is made up of four strands with a circular section, and a second type of radiant tube is the "double P" type, which is made up of three strands with substantially circular hollow sections. However, other forms of radiant elements have been proposed, for example radiant cartridges (see below).

In the heat treatment processes done by continuous or non-continuous travel of products (for example, metal strips) in front of radiant elements positioned in a furnace, the heat transfer depends on the overall heat emitting surface area (i.e., all of the surface areas of the radiant elements from which heat is radiated), the view factor (or shape factor) and the difference of the temperature (as characterized by the Stefan Boltzmann law on radiation transfers) between the radiant surface and the product to be treated.

It should be noted that, by definition, the view factor or shape factor makes it possible to define the proportion of the total flow (of heat) emitted by a first surface (S1) and arriving on a second surface (S2). In practice, the overall heat-emitting surface is formed by a series of parallel tubes generally placed transversely relative to the movement direction of the product, in the case of travel.

These tubes, installed according to practice in a furnace in vertical and/or horizontal rows, radiate heat toward the product, but at the same time, due to their side-by-side position and/or positioning above one another, the same radiant tubes radiate one another (mutual radiations). Indeed, significant surface areas of successive radiant tubes face one another, a surface of a given radiant element intercepting the radiation of another given successive radiant tube, this not making it possible to ensure optimal heating of the product, but leading to mutual overheating of the tubes, which, in certain scenarios, transmit heat to one another by radiation.

On one hand, this results in limiting the transfer of heat toward the product to be treated, since a non-negligible quantity of heat is prevented from being sent toward the latter. Indeed, when two radiant elements/tubes known from the state of the art follow one another (are placed side by side or above one another), they "bother" one another, and a loss of effective radiation surface area is observed for each of these radiant elements/tubes. Typically, this mutual radiation phenomenon causes a loss of heating capacity of the successive radiant elements/tubes, i.e., tubes placed side by side or above one another.

On the other hand, the shapes currently known for the radiant tubes of the state of the art contribute to the creation of a temperature gradient along the radiant tubes, this temperature gradient in particular having a considerable impact on the longevity of the radiant tubes.

In summary, in practice, with such radiant elements in the form of tubes, several non-negligible problems are therefore encountered, in particular including the presence of a temperature gradient along the tubes, but also the phenomenon of mutual radiation between successive tubes, which is responsible for loss of heating capacity of the product to be treated by each of the tubes. This loss of heating capacity is related to the presence of many radiant tubes in the furnaces and the small amount of free space between the latter. Indeed, there should be enough tubes to reach a sufficient heating capacity, but a large number of tubes amplifies the mutual radiation phenomenon. This results in a deterioration of the shape factor (or view factor) towards the product to be treated (strip, etc.), which is then not optimal for heating by radiation. Indeed, with the radiant elements known from the state of the art, the fraction of the radiation emitted by an element/tube and intercepted by the surface of another element/tube is non-negligible, which results in a low view factor value toward the product to be treated and a high view factor value between radiant elements (tubes or cartridges).

Although a view factor as large as possible is desirable between the radiant elements (tubes or housings) and an element to be treated, a view factor as small as possible is, on the contrary, desirable between the radiant elements (tubes or housings) following one another.

To try to address these drawbacks, document EP 1,203,921 proposes a device for indirect heating by radiation in the form of a radiant cartridge having a parallelepiped shape. More specifically, this cartridge contains a combustion channel, one end of which is connected to a burner supplied with a combustible product and a combustive by means of at least two injectors, the other end of the channel being open to allow a circulation of the combustion gases. A discharge of these combustion gases is provided via a combustion gas outlet present on the surface of the radiant cartridge. With such a heating device according to document EP 1,203,921, a flame is developed in a combustion tunnel that radiates heat toward the walls of the parallelepiped shape formed by the cartridge, those walls then in turn radiating heat toward the products to be treated.

Furthermore, although this prior document describes a heating device presented as having increased performance levels ensuring homogeneity of the temperature of the radiating walls of the cartridge and an improved view factor, the fact nevertheless remains that significant mutual radiation between the upper and lower surfaces of two successive parallelepiped cartridges is problematic, as is the case with traditional radiant tubes.

SUMMARY

The disclosure aims to offset at least this problem remaining from the state of the art by procuring a heating device that is both high-performing, i.e., having an optimized view factor between the radiant housings and elements to be treated (here, the optimization seeks an increase in this view factor) and between successive radiant housings (here, the optimization seeks a decrease in this view factor), and which makes it possible to significantly minimize the mutual radiations essentially observed at the walls of two successive radiant elements (tubes or housings) for example located above one another in a heat treatment furnace. Furthermore, the disclosure also aims to procure a heating device making it possible to improve the homogeneity of the temperatures of the radiating walls, in order to ensure homogenous heating of the elements to be treated.

To resolve this problem, or others, it is provided according to an embodiment of the disclosure to have a heating device as indicated above, wherein the radiant housing has front walls joining one another such that the housing has, in cross-section, a lenticular shape having a chord C.

For a circle, the notion of chord is defined as being a segment that joins two points of the circle, the chord that passes through the center of the circle being the diameter. By analogy, for the lenticular shape within the meaning of the disclosure, it is understood that the chord C is a segment that longitudinally cuts the lenticular shape into two parts as illustrated as an example in cross-section in FIG. 3.

The terms "the housing has, in cross-section, a lenticular shape" mean, within the meaning of one or more embodiments of the present disclosure, that the radiant housing comprises front walls that join one another at least at one end of the chord C of the lenticular shape while forming an edge or a slight flat, and not a planar surface as would be the case if the housing had a parallelepiped shape, or a continuous curved surface as would be the case if the housing had an elliptical shape.

Within the meaning of one or more embodiments of the present disclosure, the edge formed where the front walls of the radiant housing come together (i.e., at least at one end of the chord C of the lenticular shape) can have the size of a weld bead, which can be relatively wide in some cases.

Within the meaning of one or more embodiments of the present disclosure, the front walls can have, in cross-section, at least one curved part that can be preceded or followed by one or several other parts (facets) that are rectilinear or curved, the series of all of these parts forming a substantially and globally lenticular front wall. It is provided according to one or more embodiments of the disclosure that the front walls can be formed solely from curved elements (parts) or solely from rectilinear elements (parts or facets).

Within the meaning of one or more embodiments of the present disclosure, in cross-section, the lenticular shape, unlike, for example, an elliptical shape, is a discontinuous shape, i.e., a shape having at least one "angular break" for example forming an angular end, for example in the form of an intersection or a tip. It therefore certainly does not involve, unlike an elliptical shape as disclosed in document FR 1,315,564, a continuous shape made up of an infinity of arcs of circle and that can be obtained, by definition, as an envelope of the family of circles whereof the diameters are the parallel support chords of a given circle. Identically, it does not involve a closed plane curve generated by a point so moving that its distance from a fixed point divided by its distance from a fixed line is a positive constant less than 1.

"A heat source" refers, within the meaning of one or more embodiments of the present disclosure, to any element or any device allowing a heat contribution within the radiant housing. As an example, the heat source may be in the form of at least one burner provided with at least one combustible product injector, at least one combustive inlet and at least one combustion gas outlet. The heat source according to one or more embodiments of the disclosure could also be in the form of an electrical resistance or any other form.

In the context of the present disclosure, it has been determined that such a radiant housing having a lenticular shape in cross-section makes it possible to significantly minimize the mutual radiation between two successive housings and to optimize the view factor not only between one or more radiant elements (housings) and one or more elements to be treated (increase in the view factor value), but also between successive radiant elements (housings) (decrease in the view factor value).

According to one or more embodiments of the disclosure, the fraction of the radiation emitted by each of the housings and being intercepted by the product to be treated is optimized and improved relative to the devices of the state of the art (increased view factor value) with, in parallel, a reduction of the view factor value between two successive housings. This is particularly unexpected because it is obvious that the ideal shape of a radiant element would be a fine planar surface parallel to the product to be treated. Indeed, such a planar and continuous surface of a radiant element would make it possible to ensure an optimal heat transfer by radiation toward another surface that would be parallel or at least situated opposite. Yet the heating device according to one or more embodiments of the disclosure assumes the form of a radiant housing whereof the front walls come together such that the housing has a lenticular shape in cross-section. Indeed, the housing according to one or more embodiments of the disclosure has substantially convex front walls that come together at least at one end of the chord C of the lenticular shape while forming an edge: the front walls do not come together while forming a planar surface (as would be the case for a parallelepiped radiant housing) and do not come together while forming a curve (as would be the case for a radiant element having an elliptical shape), but an edge or a slight flat.

Furthermore, it has been shown, in the context of the present disclosure, that the heating device according to one or more embodiments of the disclosure has increased performance levels ensuring homogeneity of the temperature of the radiating walls of the radiant housing, while reducing the power per cubic meter of volume with respect to the traditional radiant tubes described above, but also with respect to the radiant cartridge described in document EP 1,203,921.

According to one or more embodiments of the disclosure, the radiant housing has a biconvex lenticular shape. In the context of the present disclosure, it has been determined that such a biconvex lenticular shape better approaches the radiative characteristics of an optimal radiant element that would be a fine continuous planar radiant surface.

In this sense, advantageously, the front walls of the heating device according to one or more embodiments of the disclosure come together at least at one end of the chord C of the lenticular shape while for example forming an edge or a slight flat in that location. As indicated above, such a junction of the front walls has been determined, in the context of the present disclosure, as best approaching the radiative characteristics of an optimal radiant element that would be a fine continuous planar radiant surface. It has in fact been determined that such a junction, imparting a biconvex lenticular shape to the heating device in the form of a radiant housing, is adequate both to minimize the mutual radiation between successive housings and to ensure optimal heating of the products to be treated. This optimal heating of the products to be treated and this minimization of the mutual radiation between successive housings are obtained by optimization of the view factor values not only between a radiant element (housing) and an element to be treated, but also between successive radiant elements (housings).

The lenticular shape in a cross-section of the housing according to one or more embodiments of the disclosure has a main curve radius R such that the ratio between this main curve radius R and a pitch P defined between the two centers of two successive housings is greater than 0.5. According to one or more embodiments of the disclosure, it has been determined that such a ratio greater than 0.5 between this main curve radius R and the pitch P defined between two successive housings is adequate in order to ensure optimal heating by radiation, i.e., in order to obtain an adequate view factor both between a radiant element (housing) and an element to be treated, and between successive radiant elements (housings), this being reflected by a significant minimization of the mutual radiation between two successive housings.

Optionally, the heating device according to one or more embodiments of the disclosure comprises at least one inner element for channeling gas flows and/or for stiffening.

In one embodiment according to the disclosure, the at least one inner element assumes the form of a plate and/or a structure, any other shape and/or structure of these inner elements that may be appropriate being covered by the present disclosure. In the case of heat contribution by combustion, the presence of at least one inner element, whether in the form of a plate or another form, makes it possible to channel the flow of gas from the combustion if it is arranged to constitute a partial or total separation between the flame and the part(s) adjacent to the flame area of the housing. Such an element also allows the development of the combustion in adjacent channel(s) and/or plays a stiffening and maintaining role for the system by containing the walls of the radiant housing. This element may also make it possible to control the deformation of the heating device. According to the disclosure, the structure may be a structure as simple as a rod.

The front walls of the heating device according to one or more embodiments of the disclosure can be profiled with corrugations with any shape or with indentations with any shape, in order to increase the exchange surface of the heating device according to one or more embodiments of the disclosure.

In the case of a combustion heat source, the heating device according to one or more embodiments of the disclosure comprises an inner and/or outer heat recuperator.

The inner or outer heat recuperator of the heating device according to one or more embodiments of the disclosure is a regenerative heat exchanger. It is advantageous to provide such a regenerative heat exchanger that allows better heating of the combustible product and/or combustive so as to optimize the performance of the combustion done in the housing.

Other embodiments of the heating device according to one or more embodiments of the disclosure are indicated in the appended claims.

The disclosure also relates to a furnace for the heat treatment of products, in particular for the treatment of bars, tubes, strips or parts generally made from metal or any other material, in particular such as ceramic, the furnace comprising at least one heating device according to the disclosure.

Other embodiments of the furnace are indicated in the appended claims.

The disclosure also relates to a use of a heating device according to one or more embodiments the disclosure for the treatment of bars, tubes, strips or generally metal parts or parts made from any other material, in particular such as ceramic.

Other usage forms of a heating device are indicated in the appended claims.

DESCRIPTION OF THE DRAWINGS

The foregoing aspects and many of the attendant advantages of the claimed subject matter will become more readily appreciated as the same become better understood by reference to the following detailed description, when taken in conjunction with the accompanying drawings, wherein:

In the figures, identical or similar elements bear the same references.

DETAILED DESCRIPTION

The detailed description set forth below in connection with the appended drawings, where like numerals reference like elements, is intended as a description of various embodiments of the disclosed subject matter and is not intended to represent the only embodiments. Each embodiment described in this disclosure is provided merely as an example or illustration and should not be construed as preferred or advantageous over other embodiments. The illustrative examples provided herein are not intended to be exhaustive or to limit the claimed subject matter to the precise forms disclosed.

Figure 1:
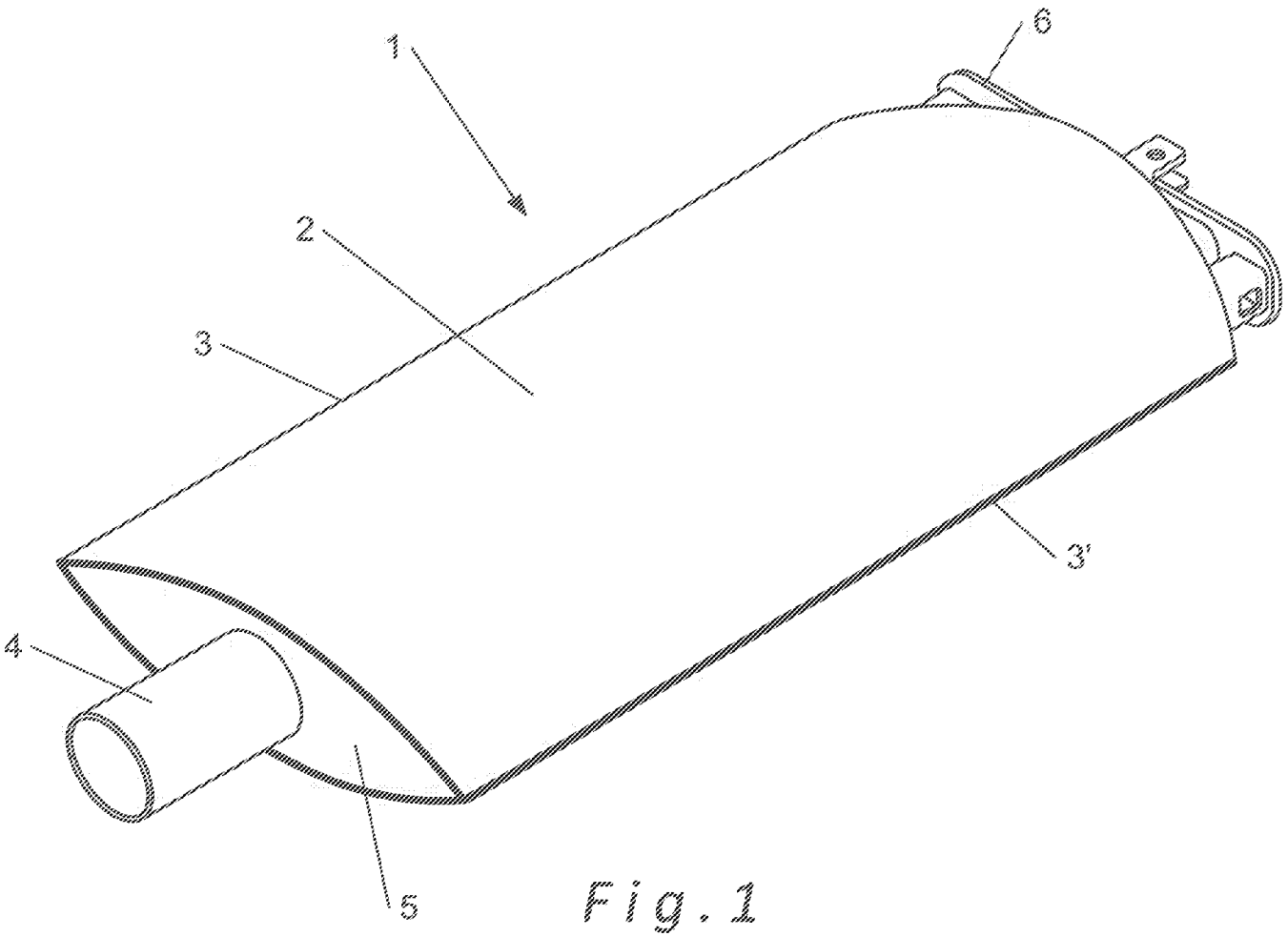
FIG. 1 is a diagrammatic perspective illustration of a representative heating device according to an aspect of the disclosure.

FIG. 1 shows a perspective view of the heating device 1 according to the disclosure. As illustrated, the heating device 1 assumes the form of a housing with a lenticular (biconvex) shape in its cross-section. This housing is made up of two substantially convex front walls 2, coming together in their upper part and their lower part, i.e., each of the ends of the chord C of the lenticular shape, forming an edge 3, 3' at that location. A location 4, for a heat source, passes through a side wall 5 of the heating device 1, and a second side wall (not visible) closes the end of the housing opposite the side wall 5 receiving the location 4 for a heat source. This second side wall is connected to an attachment and/or fastening means 6 of the housing when it is placed in a furnace.

Figure 2:
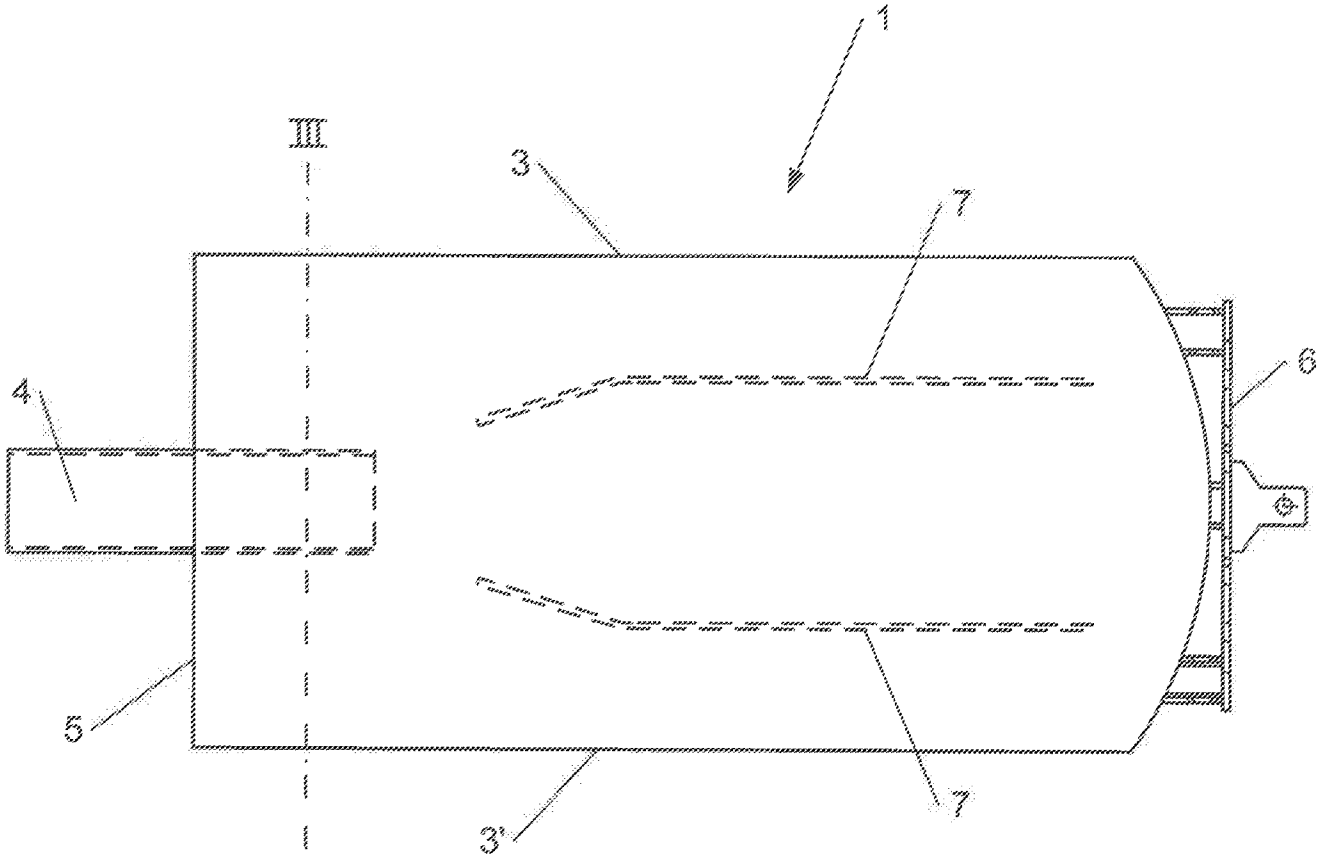
FIG. 2 is a diagrammatic front view of a representative heating device according to an aspect of the disclosure.

FIG. 2 is a side view showing the same elements as those illustrated in FIG. 1, where the inner elements 7 are shown for channeling the flow of gas and/or reinforcing in the form of plates.

Figure 3:
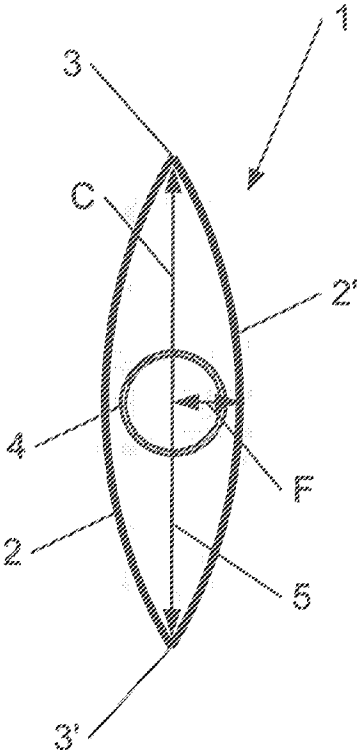
FIG. 3 is a diagrammatic cross-sectional illustration along axis III-III (as illustrated in FIG. 2) of the heating device.

FIG. 3 is a sectional view along axis III-III (as illustrated in FIG. 2) of the heating device 1 assuming the form of a housing that is lenticular in its cross-section, this lenticular shape having a sagitta F and a chord C. This housing is made up of two substantially convex front walls 2, coming together in their upper part and their lower part, i.e., each of the ends of the chord C of the lenticular shape, forming an edge 3, 3' at that location. The heating device 1 receives a location 4 for a heat source, the location 4 having a circular section in the illustrated embodiment.

During operation, when a burner present in the location 4 is supplied with a combustible product and a combustive, a flame develops in the heating device 1, i.e., in the housing, centrally according to the illustrated embodiment. When the inner elements 7 for channeling the flow of gas and/or for reinforcing are present, they also make up a screen between this central flame and the parts adjacent to the center of the housing and make it possible to channel the flow of gas related to the combustion.

Figure 4:
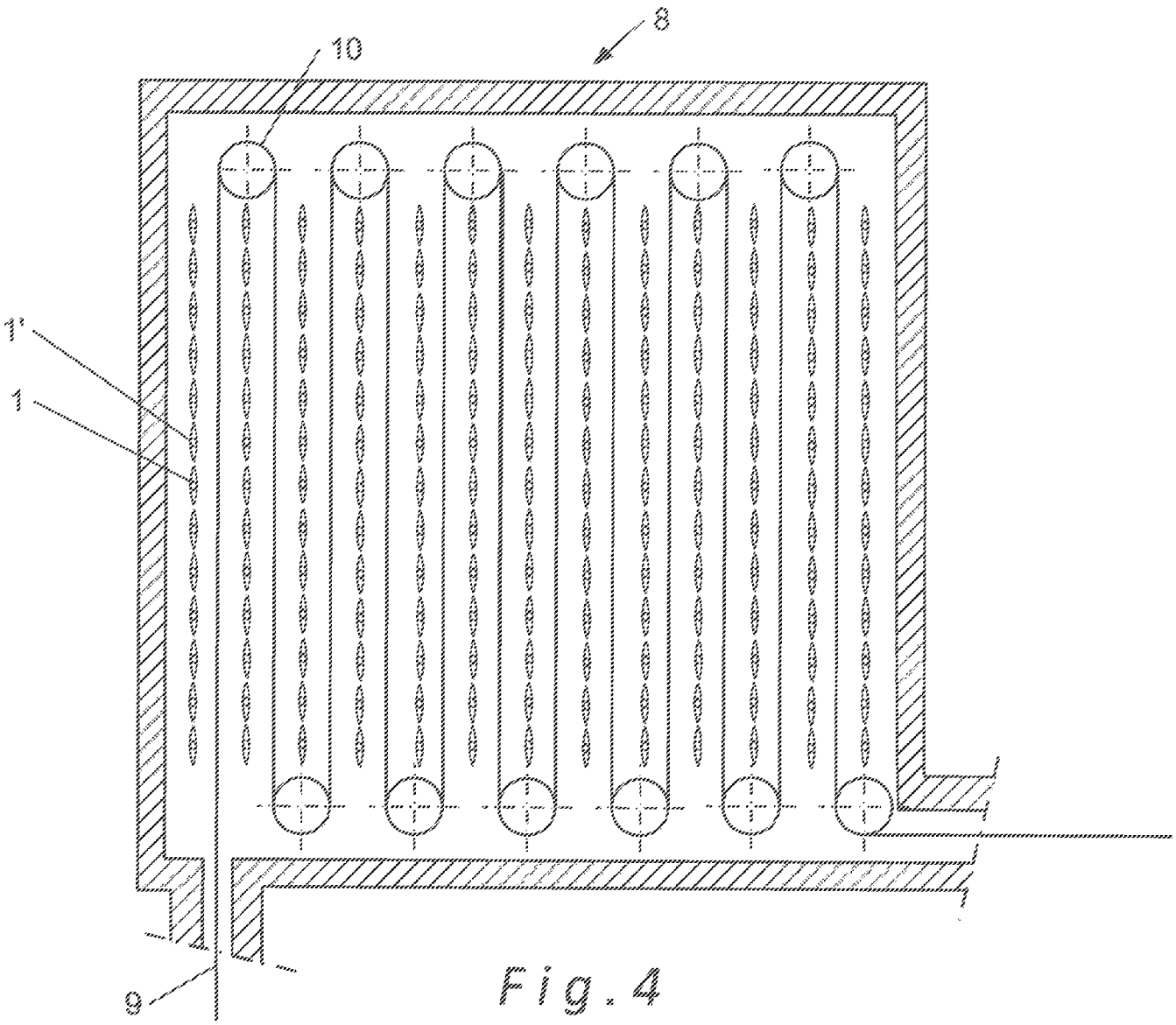
FIG. 4 is a diagrammatic illustration of one particular furnace comprising heating devices.

FIG. 4 is a diagrammatic illustration of one particular furnace 8 comprising a plurality of heating devices 1, 1' according to the disclosure. According to the illustrated embodiment, a metal strip 9 travels in the furnace while being driven by return and transport rollers 10. The strip 9 is thus heated on both of its faces by each of the heating devices 1, 1' while passing in front of the front faces 2, 2' of the latter. Due to the biconvex lenticular shape of the heating device 1, 1' according to the disclosure, the metal strip 9 is subject to homogenous heating along its entire travel in the furnace 8, the mutual radiations between successive housings 1, 1' being significantly minimized. This biconvex lenticular shape of the heating devices according to the disclosure makes it possible, as indicated above, to optimize the view factor values both between the radiant elements (housings) and an element to be treated as well as between successive radiant elements (housings).

Figure 5:
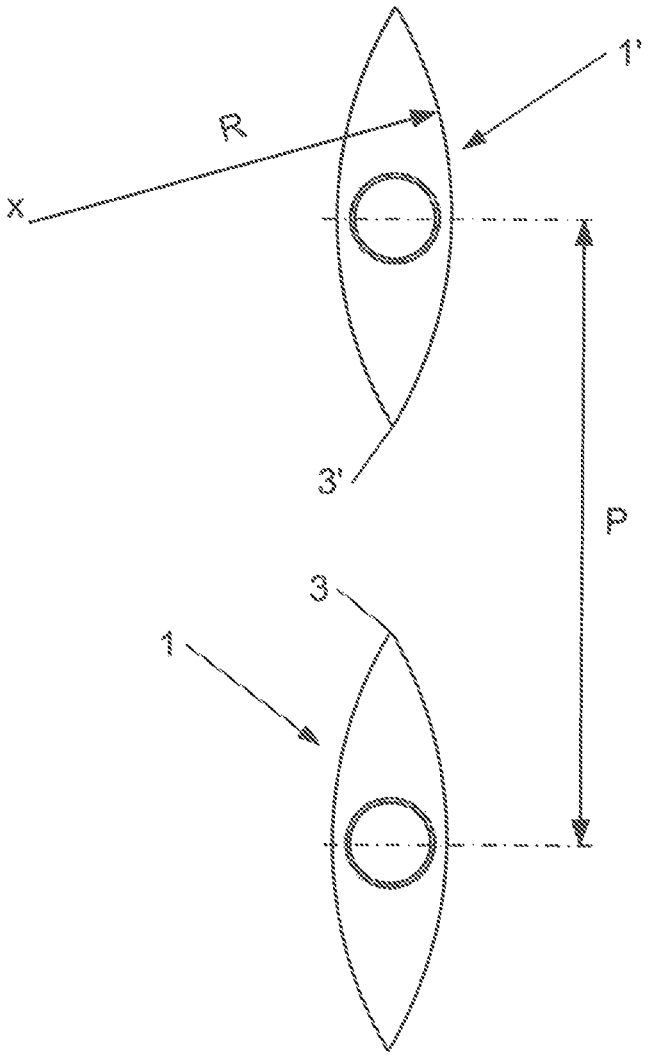
FIG. 5 is a diagrammatic illustration of two heating devices that are placed above one another, as is for example the case in a furnace (like that shown in FIG. 4)

FIG. 5 is a diagrammatic illustration of two heating devices 1, 1' that are placed above one another, as is for example the housing in a furnace 8 according to the disclosure. As can be seen, when two successive housings 1, 1' are placed above one another, only the edges 3, 3' face one another, which greatly minimizes the mutual radiations between these same housings 1, 1' and optimizes the view factors of each of the heating devices 1, 1'.

Furthermore, it has been determined that preferably, the housing 1, 1' has, in cross-section, a lens shape (lenticular shape) whereof the main curve radius R is such that the ratio between this main curve radius R and the pitch P defined between two successive housings 1, 1' is greater than 0.5.

Figure 6:
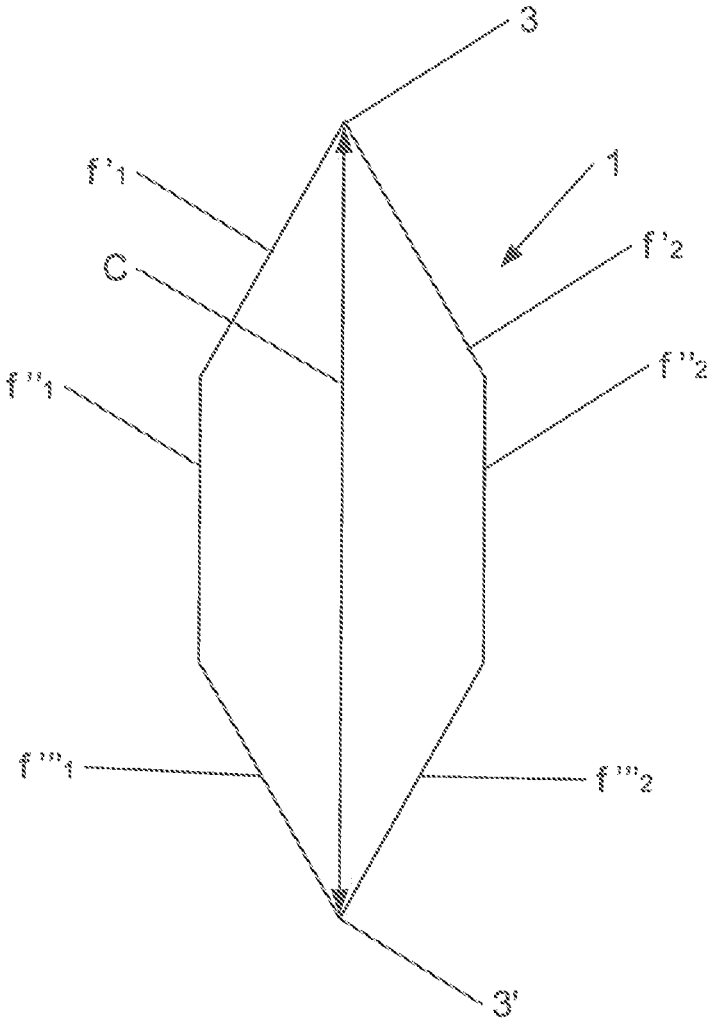
FIG. 6 is a diagrammatic illustration of another heating device according to an aspect of the disclosure.

FIG. 6 is a diagrammatic illustration of another heating device according to an aspect of the disclosure having a lenticular shape inasmuch as the housing 1 has front walls each made up of three facets $f_1'$, $f_1''$, $f_1'''/f_2'$, $f_2''$, $f_2'''$, these walls coming together such that the housing has, in cross-section, a lenticular shape according to the disclosure having a chord C. More particularly, the front walls come together at each of the ends of the chord C of the housing 1 as shown in FIG. 6, forming an edge (3, 3') in that location. This makes it possible to significantly minimize the mutual radiations between housings and optimize the view factors of the heating device according to the disclosure. Of course, the heating device shown in FIG. 6 is only an illustration, and another heating device could have a high number of facets globally forming a front wall with a lenticular shape in cross-section.

EXAMPLES

Example 1: Comparison of the Power Per Cubic Meter of Volume of the Combustion Space for Different Types of Radiant Elements Comparisons have been done in order to determine the power per cubic meter of volume and square meter of flame passage section of a heating device of the present disclosure relative to the traditional radiant tubes described above, as well as relative to the radiant cartridge described in document EP 1,203,921. The results obtained are shown in the table below.

| | | Combustion space | | | Surface power | Power |
|---|---|---|---|---|---|---|
| Shape of the radiant element | Burner power[1] [kW] | Diameter/ Dimension [mm] | Section [$m^2$] | Volume [$m^3$] | density [kW/ $m^2$] | density [kW/ $m^3$] |
| 4 strands (W) | 174 | 203 | 0.0324 | 0.243 | 5,370 | 716 |
| 3 strands (double P) | 140 | 247 | 0.0479 | 0.203 | 2,923 | 690 |
| Cartridge EP 1,203,921 | 130 | 104 × 740 | 0.0770 | 0.139 | 1,690 | 935 |
| Lenticular | 174 | 350[2] | 0.0962 | 0.598 | 1,808 | 290 |

[1]connected power
[2]equivalent diameter at the center of the lenticular housing As one can see, with the housing having a biconvex lenticular shape in its cross-section, the power per cubic meter of volume of the combustion area is significantly reduced relative to that observed with the radiant tubes and the radiant cartridge of the state of the art. This results in a significant improvement to the homogeneity of the temperature of the flame, and therefore of the radiating walls. Heating by significantly more homogenous radiation is thus obtained with a heating device disclosed herein.

Example 2: Comparisons of the View Factor Values for Radiant Housings with a Lenticular Shape and an Elliptical Shape Comparisons have been done in order to determine the view factor values for radiant housings with a lenticular shape or an elliptical shape having either the same perimeter or the same surface area. In order to perform these comparisons, in each of the housings, the distance (pitch) between two lenticular housings or between two successive elliptical housings has been set at 1444 mm (see table below).

As mentioned above, to be able to compare the computed view factor values, the following were considered:

an elliptical radiant housing whereof the perimeter, in cross-section, is identical to that of a given lenticular housing, and an elliptical radiant housing whereof the surface area, in cross-section, is identical to that of a given lenticular housing.

The view factor values were computed using the crossed strings method well known by those skilled in the art.

The table below shows the results obtained by computation:

| Lenticular radiant housing | Elliptical radiant housing: perimeter, in cross-section, identical to that of the lenticular radiant housing | Elliptical radiant housing: surface area, in cross-section, identical to that of the lenticular radiant housing |
|---|---|---|
| Sagitta: 177 mm<br>Cord: 1303 mm<br>Vertical (pitch): 1440 mm<br>Surface area: 312,001 $mm^2$<br>Half-perimeter: 1366.2 mm<br>Housing-housing view factor: 0.0384 | Small half-axis: 177 mm<br>Large half-axis: 636.7 mm<br>Vertical (pitch): 1440 mm<br>Surface area: 354,023 $mm^2$<br>Half-perimeter: 1366.2 mm<br>Housing-housing view factor: 0.0478 | Small half-axis: 177 mm<br>Large half-axis: 561 mm<br>Vertical (pitch): 1440 mm<br>Surface area: 312,001 $mm^2$<br>Half-perimeter: 1239.3 mm<br>Housing-housing view factor: 0.0419 |

As can be seen from these comparisons, for a same distance between successive radiant housings (1440 mm) having a same perimeter (2732.4 mm) or a same surface area (312,001 $mm^2$), a lower view factor value between successive radiant housings (0.0384) is observed for radiant housings with a lenticular shape according to an aspect of the disclosure compared to elliptical radiant housings (view factor of 0.0478 for a same perimeter as that of the lenticular housing and view factor of 0.0419 for a same surface area as that of the lenticular housing).

An optimized view (shape) factor is therefore obtained with a heating device according to one or more embodiments of the disclosure, which allows a significant reduction in the mutual radiations between successive housings. Consequently, with a lenticular radiant housing, the view factor between successive radiant elements (radiant housings) is optimized when that view factor should indeed be minimized, i.e., when the total heat flow emitted from a surface ($S_1$) of a first radiant housing and arriving on a surface ($S_2$) of a second radiant housing should be minimized.

It is clearly understood that the present disclosure is in no way limited to the embodiments described above, and that changes may be made thereto without going beyond the scope of the appended claims.

The principles, representative embodiments, and modes of operation of the present disclosure have been described in the foregoing description. However, aspects of the present disclosure which are intended to be protected are not to be construed as limited to the particular embodiments disclosed. Further, the embodiments described herein are to be regarded as illustrative rather than restrictive. It will be appreciated that variations and changes may be made by others, and equivalents employed, without departing from the spirit of the present disclosure. Accordingly, it is expressly intended that all such variations, changes, and equivalents fall within the spirit and scope of the present disclosure, as claimed.

The embodiments of the invention in which an exclusive property or privilege is claimed are defined as follows:

1. A device for indirect heating by radiation in the form of a radiant housing including an inner cavity delimited by two convex front walls and two side walls and comprising at least one heat source, said two convex front walls being joined to one another at first and second edges such that the radiant housing has, in cross-section, a lenticular shape that forms a sharp change of direction at the first and second edges, and wherein the two side walls are oriented transversely with respect to the two convex front walls, the device for indirect heating being configured such that the two convex front walls radiate heat from the at least one source in radially opposite directions.

2. The device according to claim 1, comprising at least one inner stiffening element for reinforcing the radiant housing, said at least one stiffening element joining said two convex front walls to one another.

3. The device according to claim 2, wherein said at least one inner element is formed as a plate.

4. The device according to claim 1, wherein said front walls of said housing are profiled with corrugations with any shape or with indentations with any shape.

5. The device according to claim 1, comprising an inner and/or outer heat recuperator.

6. The device according to claim 5, wherein said inner or outer heat recuperator is a regenerative heat exchanger.

7. A furnace for the heat treatment of products or parts comprising at least one device for indirect heating according to claim 1.

8. The furnace according to claim 7, wherein the products or parts are generally made from metal or ceramic.

9. A method of using a furnace, comprising:

treating a product or part with at least one device according to claim 1.

10. The method according to claim 9, wherein the product or part includes a bar, a tube, or a strip of metal or ceramic.

11. The device according to claim 5 wherein said at least one heat source is a combustion heat source.

12. The device according to claim 1, said device being configured to be implemented with another similar device in a furnace such that said two devices are separated by a pitch P, wherein said lenticular shape has a main curve radius R such that a ratio between R and P is larger than 0.5.

13. The device according to claim 1, wherein said lenticular shape is not a continuous curved surface.

14. The device according to claim 1, wherein the radiant housing has in cross-section a biconvex shape, and a discontinuous shape at the first and second edges.

* * * * *